United States Patent [19]

Nomoto et al.

[11] Patent Number: 4,811,029

[45] Date of Patent: Mar. 7, 1989

[54] MULTI-REFLECTOR ANTENNA

[75] Inventors: Shinichi Nomoto, Tokyo; Yoshihiko Mizuguchi, Tama; Fumio Watanabe, Tokyo, all of Japan

[73] Assignee: Kokusai Denshin Denwa Kabushiki Kaisha, Tokyo, Japan

[21] Appl. No.: 833,338

[22] Filed: Feb. 25, 1986

[30] Foreign Application Priority Data

Mar. 4, 1985 [JP] Japan ..... 60-41085

[51] Int. Cl.[4] ..... H01Q 19/19; H01Q 15/16

[52] U.S. Cl. ..... 343/779; 343/781 P

[58] Field of Search ..... 343/781 P, 781 CA, 779, 343/837

[56] References Cited

U.S. PATENT DOCUMENTS

| | | | |
|---|---|---|---|
| 4,145,695 | 3/1979 | Gans | 343/781 P |
| 4,491,848 | 1/1985 | Dragone | 343/781 P |
| 4,516,130 | 5/1985 | Dragone | 343/781 P |
| 4,535,338 | 8/1985 | Ohm | 343/837 |

*Primary Examiner*—William L. Sikes
*Assistant Examiner*—Michael C. Wimer
*Attorney, Agent, or Firm*—Emmanuel J. Lobato; Robert E. Burns

[57] ABSTRACT

A multi-reflector antenna is disclosed which is arranged so that a main reflector surface, a subreflector surface and a primary radiator are electro-magnetically coupled together. When the main reflector is represented by a coordinate $z=z(\rho, \psi)$ using cylindrical coordinate system $(z, \rho, \psi)$ in which the direction of radiation of a main beam of the main reflector surface is in correspondence with the z-axis and the subreflector surface is represented by a coordinate $r=r(\theta, \phi)$ in a vector system using a spherical coordinate system $(r, \theta, \phi)$ in which the Snell's reference direction of the primary radiator is set to $\theta=0$, the said $z(\rho, \psi)$ and $r(\theta, \phi)$ are so determined as to satisfy the law of reflection, a condition of constant path length and the following relation:

$$\psi=-\phi+\psi_0$$

$$\rho=\rho_0\tan\theta/2$$

where $\psi_0$ and $\rho_0$ are constants. The primary radiator is comprised of a plurality of horns.

2 Claims, 4 Drawing Sheets

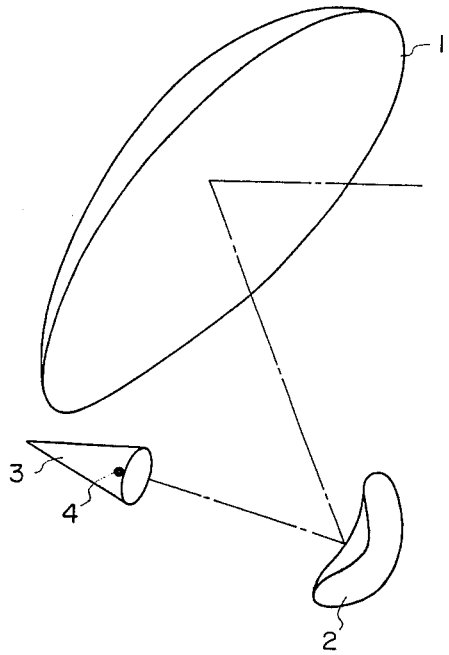
Fig. 6
Fig. 7
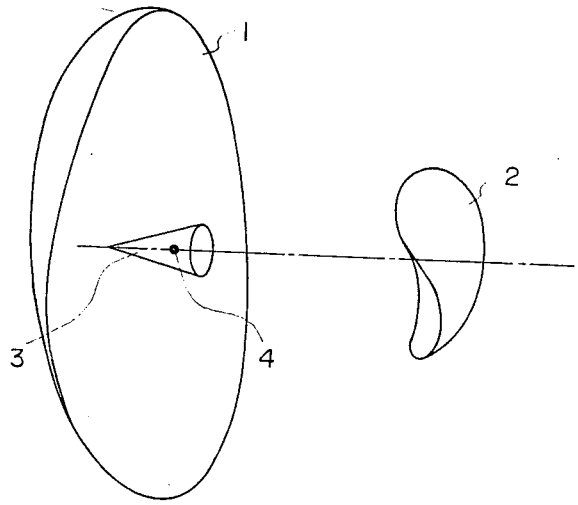

MULTI-REFLECTOR ANTENNA

BACKGROUND OF THE INVENTION

The present invention relates to antenna equipment which is provided with a main reflector, a subreflector and a primary radiator, and more particularly to a multi-reflector antenna in which the aperture distribution is rotationally symmetric.

A conventional parabolic antenna or the like of an axially symmetric structure has a substantially axially symmetric aperture distribution on one hand but on the other hand suffers lowered gain and degraded side lobe characteristics resulting from blocking in the aperture plane of the primary radiator or the like. In case of employing an offset structure with a view to avoiding the blocking, an asymmetric aperture distribution due to the asymmetric structure will generally reduce the gain and deteriorate the side lobe characteristics and cross polarization characteristic.

However, the above defects of the prior art have not yet been eliminated.

SUMMARY OF THE INVENTION

An object of the present invention is to provide, with a view to obviating the abovementioned defects of the prior art, a multi-reflector antenna which permits the provision of a rotationally symmetric aperture distribution not only in case of requiring an antenna structure offset in both vertical and lateral directions but also in a case where the mapping of the horn aperture field distribution to the antenna aperture field distribution is rotated, as desired, relative to the direction of an antenna beam.

A multi-reflector antenna is disclosed as having a main reflector surface, a subreflector surface and a primary radiator arranged for electromagnetically coupling together, characterized in that the main reflector surface is represented by a coordinate $z=z(\rho, \psi)$ in a vector system using a cylindrical coordinate system $(z, \rho, \psi)$ in which a radiation direction of a main beam of the main reflector surface is in correspondence with a z-axis of the cylindrical coordinate system $(z, \rho, \psi)$, and the subreflector surface is represented by a coordinate $r=r(\theta, \phi)$ in a vector system using a spherical coordinate system $(r, \theta, \phi)$ in which a radiation direction of a main beam of the primary radiator is in correspondence with a direction of $\theta=0$, the said coordinates $z(\rho, \psi)$ and $r(\theta, \phi)$ are so determined as to satisfy equations of Snell's law of reflection for a reflection on the main reflector surface and the subreflector surface, equations of a condition of a constant path length and a following relation.

$$\psi=-\phi+\psi_0$$

$$\rho=\rho_0 \tan \theta/2$$

where $\psi_0$ and $\rho_0$ are constants.

The primary radiator may be comprised of a plurality of horns.

BRIEF DESCRIPTION OF THE DRAWINGS

The present invention will be described in detail below in comparison with prior art with reference to accompanying drawings, in which:

FIGS. 6 and 7 are schematic perspective views illustrating other embodiments of the present invention.

DETAILED DESCRIPTION

To make differences between prior art and the present invention clear, an example of the prior art will first be described.

Figure 1:
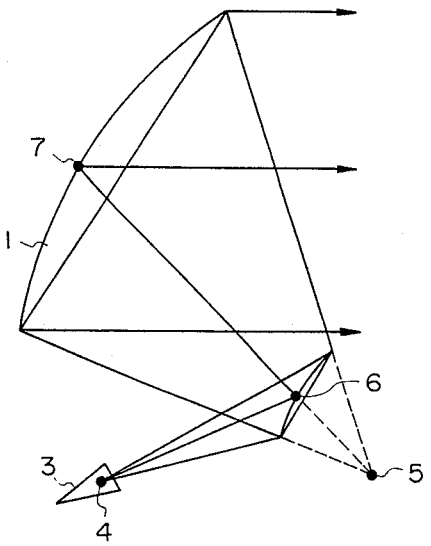
PRIOR ART Fig. 1
FIGS. 1 and 2 are layout diagrams showing conventional multi-reflector antennas.
Figure 2:
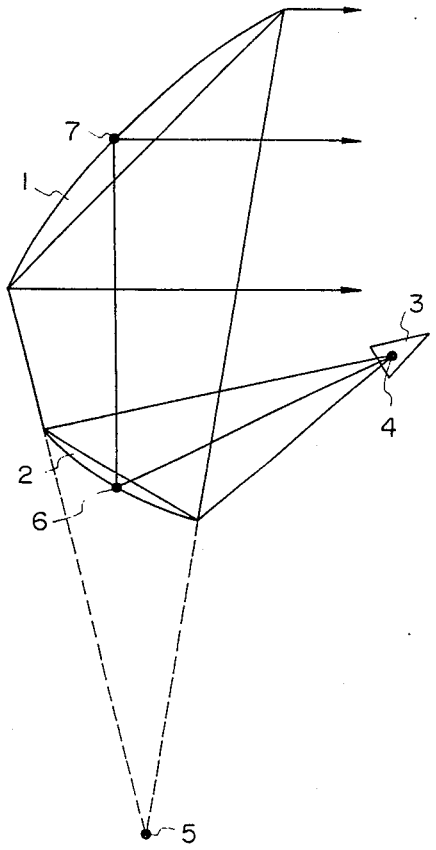
PRIOR ART Fig. 2

FIGS. 1 and 2 show conventional offset type multi-reflector antenna structures adapted to obviate the above defects, wherein two asymmetric reflectors of a main reflector and a subreflector are suitably combined whereby asymmetric field components occurring from their reflector surfaces are cancelled in the antenna aperture plane. In FIGS. 1 and 2 reference numeral 1 indicates a main reflector, 2 a subreflector, 3 a primary radiator, 4 a focal point, 5 an imaginary focal point, 6 the center of the subreflector 2 and 7 the center of the main reflector 1.

As is evident from FIGS. 1 and 2, however, it is requisite to the illustrated structures that the beam emitting directions of the primary radiator 3 and the antenna be in the same plane (in the plane of the paper) (that is, offset in the vertical direction alone). In other words, it is impossible to offset the beam radiating directions in both vertical and lateral directions while retaining the rotational symmetry of the aperture distribution.

Moreover, according to the prior art antenna, its aperture distribution is provided only as an enlarged image of the aperture distribution of a feeding horn which is non-rotated or rotated by 180° regardless of whether the antenna is single- or multi-beam, or whether its structure is axially symmetric or offset. It is therefore impossible that the antenna aperture distribution is obtained as if it were an image of the feeding horn aperture distribution rotated by 90° by way of example.

The present invention makes a feature of allowing a high degree of freedom in the antenna construction through use of reflector surfaces which are intrinsically different from those employed in the prior art.

Figure 3:
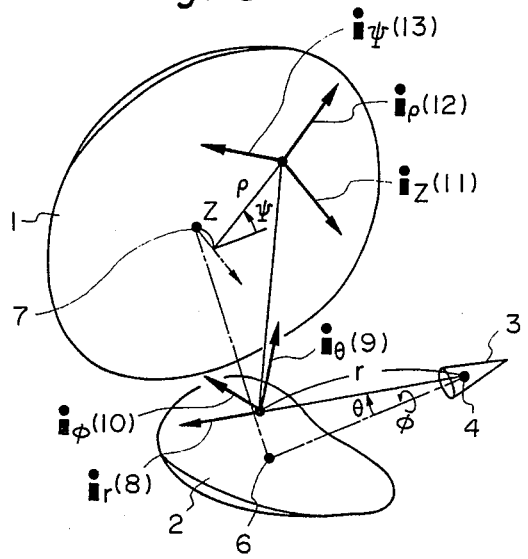
FIG. 3 is a schematic perspective view explanatory of the principles of the present invention.

FIG. 3 shows an antenna structure and its coordinate system for explaining the present invention. In the following description the gothic type character indicates a vector, $\mathbf{i}$ a unit vector and $\mathbb{X}$ a position vector. In FIG. 3 reference numeral 1 identifies a main reflector, 2 a subreflector, 3 a primary radiator and 4 a focal point. Reference numeral 6 designates the central point $\mathbb{X}_{s0}$ of the subreflector 2, 7 the central point $\mathbb{X}_{m0}$ of the main reflector 1, 8 $_r$, 9 $\mathbf{i}_\theta$, 10 $\mathbf{i}_{100}$, 12 $\mathbf{i}_\rho$ and 13 $\mathbf{i}_\psi$. In this instance, $(\mathbf{i}_z, \mathbf{i}_\rho, \mathbf{i}_\psi)$ is the basic vector of a circular cylindrical coordinate system $(z, \rho, \psi)$ in which a main radiating direction is $\mathbf{i}_z$, and $(\mathbf{i}_r, \mathbf{i}_\theta, \mathbf{i}_\phi)$ is the basic vector of a spherical coordinate system $(r, \theta, \phi)$ in which $r=0$ is a focal point $\mathbb{X}_f$ and $\theta=0$ is an $\mathbb{X}_{s0}-\mathbb{X}_f$ direction. The main reflector 1 and the subreflector 2 are represented by $\mathbb{X}_m=z\mathbf{i}_z+\rho\ \rho$ and $\mathbb{X}_s=r\mathbf{i}_r+\mathbb{X}_f$, respectively, using the abovesaid coordinate systems. Incidentally, FIG. 3 shows a general case in which the antenna beam radiating direction $_z$ is not arranged in parallel to a plane defined by three points of the focal point $\mathbb{X}_f$ and the central points $\mathbb{X}_{s0}$ and $\mathbb{X}_{m0}$ of the subreflector and the main reflector.

Now, using Snell's law of reflection for a reflection on the main reflector surface, which is represented by $$\mathbb{i}_z = \mathbb{i}_s - 2(\mathbb{i}_s \cdot \mathbb{m}_m)\mathbb{m}_m$$

where $$\mathbb{i}_s = \frac{\mathbb{X}_m - \mathbb{X}_s}{|\mathbb{X}_m - \mathbb{X}_s|}$$

and $$m = \frac{\frac{\partial \mathbb{X}}{\partial \rho} \times \frac{\partial \mathbb{X}_m}{\partial \psi}}{\left| \frac{\partial \mathbb{X}}{\partial \rho} \times \frac{\partial \mathbb{X}_m}{\partial \psi} \right|} \quad \text{(unit normal vector of the subreflector surface)}$$

Snell's law of reflection for a reflection on the subreflector surface, which is represented by $$\mathbb{i}_s = \mathbb{i}_r - 2(\mathbb{i}_r \cdot \mathbb{m}_s)\mathbb{m}_s,$$

where $$s = \frac{\frac{\partial \mathbb{X}_s}{\partial \theta} \times \frac{\partial \mathbb{X}_s}{\partial \phi}}{\left| \frac{\partial \mathbb{X}_s}{\partial \theta} \times \frac{\partial \mathbb{X}_s}{\partial \phi} \right|} \quad \text{(unit normal vector of the subreflector surface)}$$

and the condition of a constant path length (hereinafter identified by K, which is represented by $$r + |\mathbb{X}_m - \mathbb{X}_s| - Z = K$$

the curved surface of the main reflector 1 and the subreflector 2 can be obtained as solutions of the following equations:

$$\left.\begin{aligned} \frac{\partial z}{\partial \rho} &= \frac{1}{P}\{(t_1 t_{15} + t_5 t_{11})z + (t_1 \omega - t_{11} t_{16})\} \\ \frac{\partial z}{\partial \psi} &= \frac{\rho}{P}\{(t_2 t_{15} + t_5 t_{12})z + (t_2 \omega - t_{12} t_{16})\} \end{aligned}\right\} \quad (1)$$

$$r = -\frac{t_{15} z + \omega}{t_5 z - t_{16}} \quad (2)$$

$$\left.\begin{aligned} &\text{where } P = t_5 \omega + t_{15} t_{16} \\ &t_1 = \mathbb{i}_\rho \cdot \mathbb{i}_r \\ &t_2 = \mathbb{i}_\psi \cdot \mathbb{i}_r \\ &t_5 = 1 - \mathbb{i}_z \cdot \mathbb{i}_r \\ &t_{11} = \mathbb{D} \cdot \mathbb{i}_\rho \\ &t_{12} = \mathbb{D} \cdot \mathbb{i}_\psi \\ &t_{15} = \mathbb{D} \cdot \mathbb{i}_z - K \\ &t_{16} = \mathbb{D} \cdot \mathbb{i}_r - K \\ &\omega = \frac{1}{2}(\mathbb{D} \cdot \mathbb{D} - K^2) \\ &\mathbb{D} = \rho \mathbb{i}_\rho - \mathbb{X}_f \end{aligned}\right\} \quad (3)$$

Those of the above solutions which satisfy the following conditions are smooth, realizable reflector surfaces and have a rotationally symmetric distribution in the antenna aperture plane:

$$\left.\begin{aligned} \psi &= -\phi + \psi_0 \\ \rho &= \rho_0 \tan \frac{\theta}{2} \end{aligned}\right\} \quad (4)$$

where $\psi_0$ and $\rho_0$ are given constants.

The reflector surfaces can be obtained by solving an ordinary differential equation which is obtained when erasing $\theta$ and $\phi$ in Eq. (1) through use of Eq. (4).

Figure 4:
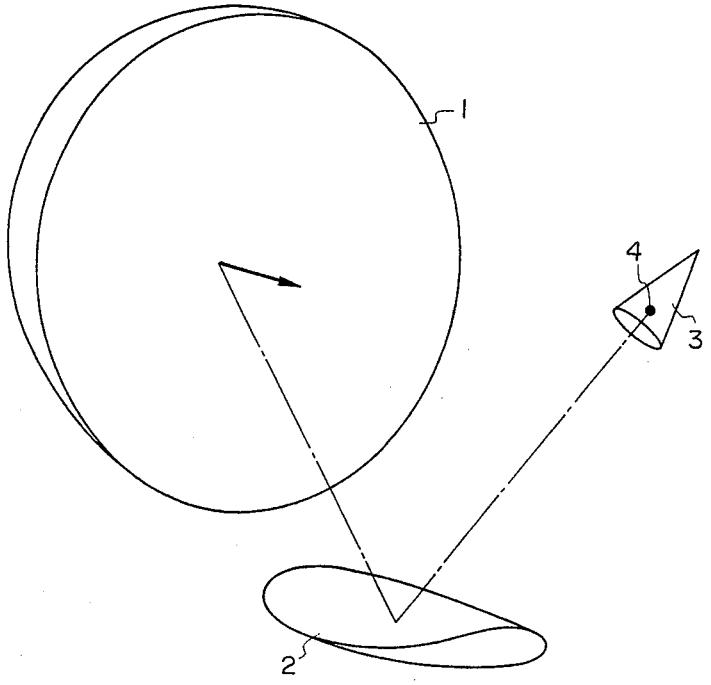
FIG. 4 is a schematic perspective view illustrating an embodiment of the present invention which employs a single feeding horn.
Figure 5:
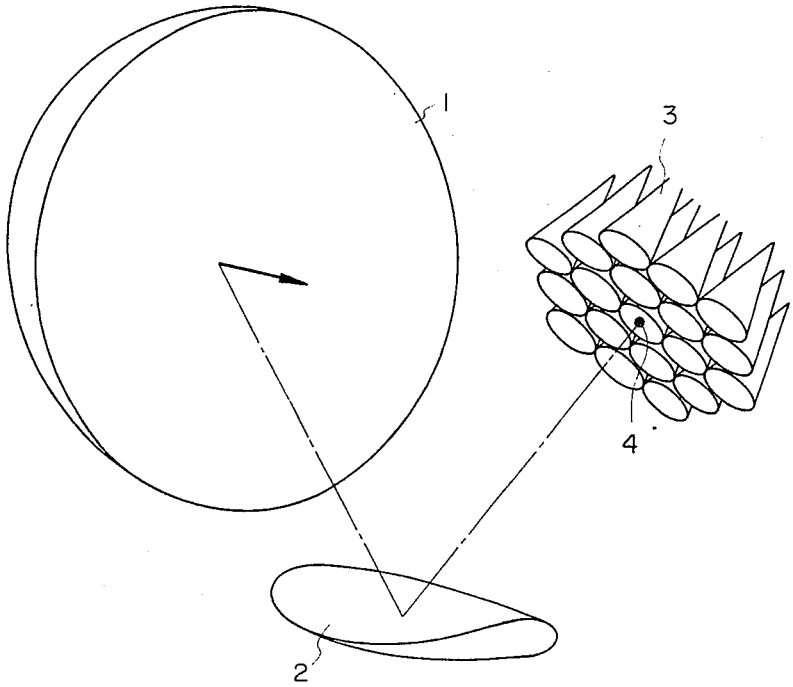
FIG. 5 is a schematic perspective view illustrating another embodiment of the present invention which employs a plurality of feeding horns.

FIG. 4 illustrates an embodiment which employs one feeding horn as the primary radiator 3 and FIG. 5 an embodiment of a multibeam antenna for satellites which employs a feed cluster as the primary radiator 3. In either case, since the two reflectors 1 and 2 are offset in both vertical and lateral directions, the antenna is further reduced in volume as compared with the prior art antenna offset only in the vertical direction.

FIG. 6 illustrates an embodiment of an antenna offset only in the vertical direction, which is obtained in a case where the antenna beam radiating direction $\mathbb{i}_z$ is arranged in a plane defined by the focal point $\mathbb{X}_f$, the central point $\mathbb{X}_{s0}$ of the subreflector 2 and the central point $\mathbb{X}_{m0}$ of the main reflector 1, that is, in the case of solving the aforementioned equation while adding the following condition:

$$\mathbb{i}_z \cdot \{(\mathbb{X}_{M0} - \mathbb{X}_F) \times (\mathbb{X}_{s0} - \mathbb{X}_F)\} = 0 \quad (5)$$

This materializes the antenna aperture distribution that the aperture distribution of the feeding horn is rotated by $\psi_0$ (see Eq. (4)) in the antenna aperture plane.

FIG. 7 illustrates an embodiment of the present invention which is implemented when the antenna and the primary radiator 3 are common in the beam radiating direction, that is, under the following condition:

$$\mathbb{i}_z \times (\mathbb{X}_{m0} - \mathbb{X}_F) = {}_z \times (\mathbb{X}_{s0} - \mathbb{X}_F) = \mathbb{0} \quad (6)$$

Also in this case, a novel antenna can be obtained which has an antenna aperture distribution rotated by the desired angle $\psi_0$.

The multi-reflector antenna of the present invention, described above, implements a reflector system which makes the aperture distribution rotationally symmetric regardless of the arrangement of the main reflector, the subreflector and the primary radiator and while it has freedom of arbitrarily determining the constants $\psi_0$ and $\rho_0$.

What we claim is:

1. A multi-reflector antenna having a main reflector surface, a subreflector surface and a primary radiator are arranged for electromagnetically coupling together, characterized in that the main reflector surface is represented by a coordinate $z = z(\rho, \psi)$ in a vector system using a cylindrical coordinate system $(z, \rho, \psi)$ in which a radiation direction of a main beam of the main reflector surface is in correspondence with a z-axis of the cylindrical coordinate system $(z, \rho, \psi)$ and the subreflector surface is represented by a coordinate $r = r(\theta, \phi)$ in a vector system using a spherical coordinate system $(r, \theta, \phi)$ in which a radiation direction of a main beam of the primary radiator is in correspondence with a direction of $\theta = 0$, the said coordinates $z(\rho, \psi)$ and $r(\theta, \phi)$ are so determined as to satisfy equations of Snell's law of reflection for a reflection on the main reflector surface and the subreflector surface, equations of a condition of a constant path length and a following relation:

$$\psi = -\phi + \psi_0$$

$$\rho = \rho_0 \tan \theta/2$$

where $\psi_0$ and $\rho_0$ are constants.

2. A multi-reflector antenna according to claim 1, in which said primary radiator is comprised of a plurality of horns.

* * * * *